US007377486B2

(12) United States Patent
Winter et al.

(10) Patent No.: US 7,377,486 B2
(45) Date of Patent: May 27, 2008

(54) SUPPORT FRAME OF A HOISTING MACHINE

(75) Inventors: Klaus-Jürgen Winter, Wetter (DE); Jürgen Backsmann, Hagen (DE)

(73) Assignee: Demag Cranes & Components GmbH, Wetter (DE)

( * ) Notice: Subject to any disclaimer, the term of this patent is extended or adjusted under 35 U.S.C. 154(b) by 48 days.

(21) Appl. No.: 11/472,944

(22) Filed: Jun. 22, 2006

(65) Prior Publication Data

US 2007/0029533 A1 Feb. 8, 2007

(30) Foreign Application Priority Data

Jun. 23, 2005 (DE) ..... 10 2005 029113

(51) Int. Cl.
*B66D 3/00* (2006.01)

(52) U.S. Cl. ..... 254/380; 254/383; 254/362; 254/342

(58) Field of Classification Search ..... 254/266, 254/323, 333, 342, 362, 380, 383, 405
See application file for complete search history.

(56) References Cited

U.S. PATENT DOCUMENTS 3,834,671 A * 9/1974 Du Mesnil du Buisson ..... 242/396
5,098,068 A * 3/1992 Jussila ..... 254/342
5,603,489 A * 2/1997 Regal ..... 254/378
5,816,564 A * 10/1998 Winter ..... 254/266
6,394,420 B2 * 5/2002 Kiviniitty ..... 254/333
6,494,437 B1 * 12/2002 Boyer ..... 254/323
6,619,625 B2 * 9/2003 Kiviniitty ..... 254/342
6,793,203 B2 * 9/2004 Heinrichs et al. ..... 254/342
6,966,544 B2 * 11/2005 McCormick et al. ..... 254/342

FOREIGN PATENT DOCUMENTS

DE 196 02 927 A1 7/1997

* cited by examiner

*Primary Examiner*—Emmanuel M Marcelo
(74) *Attorney, Agent, or Firm*—Van Dyke, Gardner, Linn & Burkhart, LLP

(57) ABSTRACT

A hoisting machine, such as a cable block, includes a support frame having at least two face plates, which are detachably joined together and spaced apart by at least two longitudinal members. The support frame includes a simple structural design, in which the longitudinal members are detachably joined to the face plates such that the ends of the longitudinal members are pressed against a bearing surface of the face plates in the direction of their lengthwise axis, transversely to the longitudinal member.

28 Claims, 2 Drawing Sheets

SUPPORT FRAME OF A HOISTING MACHINE

FIELD OF THE INVENTION

The invention relates generally to hoisting devices, and specifically to support frames for hoisting devices.

BACKGROUND OF THE INVENTION

A motor cable winch for lifting chores in the theater is known from German patent application DE 43 10 770 A1. This motor cable winch is operated by an electric drive motor, which acts on a cable drum via a gearing. The gearing is arranged together with two brakes inside the cable drum. The cable drum is mounted at both ends in a support frame, which essentially consists of two face plates which are spaced apart and oriented parallel to each other, which are fastened together by four rods oriented parallel to the lengthwise axis of the cable drum. The rods are fashioned as spacing tubes, each of them being joined to the face plates by means of a tie rod laid inside the spacing tube and threaded nuts screwed onto its ends. The planar end surfaces of the spacing tubes lie against the inside of the face plates in the region of continuous boreholes for the tie rods.

Furthermore, lifting machines, such as electric cable winches, are described in the introduction to the specification of German patent application DE 196 02 927 A1, having a modular design made up of the subassemblies including electrical, motor, gearing, cable drum, supporting means and support frame. The individual subassemblies can be assembled detachably, which provides for a plurality of combinations. The main subassemblies of the hoisting machine are fastened to the support frame; in particular, the cable drum is mounted there. The support frame consists of at least two face plates, arranged parallel to each other and spaced apart. The face plates are joined together by longitudinal members. Each face plate is provided with at least three screw connection points to attach the longitudinal member.

German patent application DE 196 02 297 A1 pertains to a support frame for cable winches, and claims to be characterized by less installation expense and lower weight. The support frame essentially consists of the two face plates, which are joined together only by an upper and a lower U-shaped longitudinal member and a tension element parallel thereto, which coincides with the axis of rotation of the cable drum. The tension element is made of solid material, with opposite ends at which threaded rod segments are arranged to form a shoulder. At one side, the tension element is screwed by its threaded rod segment into an inner thread located centrally in one face plate. Its annular shoulder abuts against the planar inside of the face plate via a washer. At the opposite face plate, a central continuous borehole of step shape is provided to form an annular bearing surface to receive the shoulder of the tube at the start of the threaded rod segment. The threaded rod segment is led through the continuous borehole and is tightened against the outside of the face plate from the outside via a threaded nut. The two U-shaped longitudinal members are inserted into suitable recesses in the inside of the face plates, where they are held by the clamping force between the face plates exerted by the tension means.

In these embodiments of the prior art, the connection elements between the face plates are fashioned as profiles with solid round or tubular cross sections, the ends of which project into corresponding boreholes or appropriately machined bearing surfaces in the mutually facing surfaces of the face elements or thrust against them. A fastening is then accomplished by a screw connection, which tightens the profiles in their lengthwise direction against the face plates. These connection points between the profiles and the face plates can transmit both axial forces in the direction of the lengthwise axis of the connection elements or the cable drum, as well as so-called corner torques. Here, corner torques refer to torques which arise, for example, from a twisting of the support frame at the connection points between face plates and connection elements. At the same time, the exact spacing and parallelness between the two face plates is produced within the desired tolerances via the length of the profiles.

In connection with the above-described screw fastening, each end surface of the profiles is clamped against a corresponding shoulder surface of the face plate or in a borehole of the face plate. For such connections with axial clamping, the end surfaces of the profiles and the bearing surfaces at the face plates must fulfill certain requirements. Close tolerances must be held in terms of being perpendicular to the axis of the borehole, since the clamping is occurring against these surfaces and the axial pressure should be distributed as evenly as possible over the circumference of the end surfaces.

In addition to the bearing surface at the inside of the face plate, yet another planar bearing surface needs to be made against its outside, so that the bearing surfaces for the threaded nut and/or bolt of the connection also lie perpendicular to the axis of the borehole.

The shape stability of the connection when the support frame is subjected to torque will depend on the size of the annular end surfaces, since a slight gap must be present between the inner surface of the borehole in the face plate and the outer diameter of the profiles, for installation reasons.

The structural elements of the hoisting machine, previously referred to as face plates, can also be housing parts, fulfilling various functions of the hoisting machine. For example, they may serve to fasten the lift drive, to stow the cable drum, to mount on cross arms for the cable reeving parts, to accommodate the electrical equipment, to secure the base of the hoisting machine or to mount the running gear parts.

Therefore, the threaded nuts or bolts for fastening the profiles to the face plates are often poorly accessible; for example, they are arranged inside the housing. Also, the connection points must often be removed from the housing to gain access, which makes installation difficult. In addition, the housing, namely, the face plates, must be needlessly enlarged.

SUMMARY OF THE INVENTION

The present invention provides a hoisting device or machine, such as a cable block, having a support frame with a simple structural design that provides access to the components. According to an aspect of the invention, a hoisting device includes a support frame having at least two face plates detachably joined together and spaced apart by at least two longitudinal members, which are detachably joined to the face plates. Each longitudinal member has a lengthwise axis and two ends, wherein the ends are pressed against a bearing surface of the face plates transversely to the longitudinal members. Bearing surfaces only need to be created at the face elements for the longitudinal members, i.e., there is no need to make bearing surfaces for the usual axial screw fastening of the prior art. Thus, the configuration of the support frame of the present invention minimizes fabrication expense. Furthermore, an appropriate machining of the bearing surface may achieve the desired axial parallelness of the bearing surface and the longitudinal member, regardless of the perpendicularity of the contact surface at the end between the longitudinal member and the face plate with regard to the lengthwise axis of the longitudinal member. Optionally, a contact may be included at the end surface between the longitudinal member and the face plate.

Optionally, the ends of the longitudinal members may each be pressed against the bearing surface by a connection element, which acts radially when viewed in the direction of the lengthwise axes of the longitudinal members and thrusts against the face plate. Thus, the longitudinal members may each be joined by friction to the face plates. Optionally, the connection element may be a stud.

Optionally, one end of the connection element may be worked into the outer circumferential surface of the longitudinal member to produce a form fitting, in addition to the frictional fitting. A form fitting may enhance the stability and strength of the radial connection of the longitudinal members to the face plates. Again, the connection element may be a stud.

Optionally, the stud may be a threaded pin with an annular cutting edge to create the desired form fitting.

Optionally, boreholes may be arranged in the mutually facing inner surfaces of the face plates, into which the ends of the longitudinal members may be inserted. The length of insertion of the ends of the longitudinal members into the boreholes may be greater than the diameter of the ends of the longitudinal members. The greater length of the bearing surface may result in a greater shape stability when subjected to corner torques, as compared to the customary axial clamping of the prior art. The required material expense and, thus, the manufacturing costs of the longitudinal members between the face plates are dictated primarily by the required moment of inertia from the torque loading of the support frame by the cable block, the swaying of the load, inaccuracies during setup, or by unforeseen impacts against these elements during transport or other unacceptable straining. The radial connection may minimize the corner torque loading.

Furthermore, the boreholes for the ends of the longitudinal members may be blind boreholes with cylindrical cross sections and, thus, easy to fabricate. These blind boreholes may result in only a slight manufacturing expense, since the only machining work required may be completed in a single clamping position.

Optionally, the stud may be screwed into a threaded borehole, the lengthwise axis of which points transversely to the lengthwise axis of the longitudinal member. The threaded borehole may be arranged in a region of the face plates which borders on the borehole. Thus, the above-described radial clamping is achieved.

Optionally, the face plates may be rectangular and have four corners, with a borehole arranged in each corner. These boreholes may be arranged concentrically to the center point of the cable drum and may be staggered by 90 degrees relative to one another. Although only two longitudinal members are required to form the support frame, four boreholes may be provided. Thus, the longitudinal members can be arranged on the face plates regardless of the anticipated run-out of the cable, i.e., without hindering it. These boreholes may also be used to fasten additional mounted parts to the hoisting machine.

Thus, the present invention provides radial clamping of the longitudinal members to the face plates, as opposed to the customary axial clamping. As a result of the radial clamping and the strength of the connection between the longitudinal members and the face plates, it may become possible to use only two longitudinal members, which may be fastened in parallel and diagonally opposite to the face plates. These two longitudinal members may achieve a sufficient stability for the overall support frame. Also, it may be possible to minimize the number of structural parts and, thus, the installation expense, as well as consumption of material. No threaded rods laid in the tubes are required.

Optionally, the longitudinal members may be configured as round tubes. The thin-walled round tubes may result in a favorable ratio between material expenditure and moment of inertia. Optionally, the longitudinal members may be a single piece.

Optionally, a cable drum may be mounted in the support frame of the present invention at either end between the face plates, wherein the cable drum may have an axis of rotation parallel to the lengthwise axis of the longitudinal members.

These and other objects, advantages, purposes and features of the present invention will become apparent upon review of the following specification in conjunction with the drawings.

DESCRIPTION OF THE PREFERRED EMBODIMENTS

Figure 1:
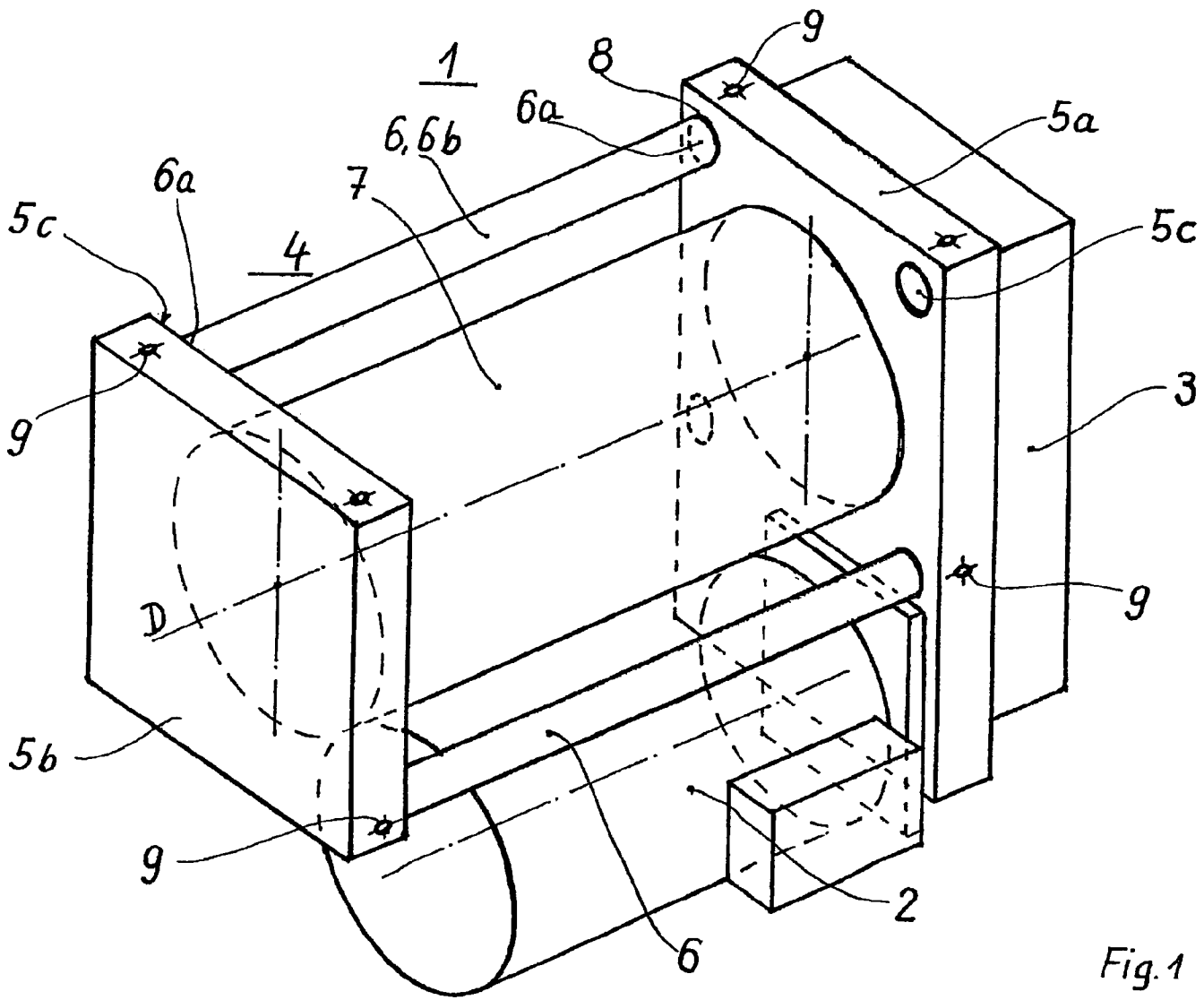
FIG. 1 is a perspective view of a hoisting device according to the present invention.

Referring now to the drawings and the illustrated embodiments depicted therein, a cable block 1 of a hoisting device or machine is driven by an electric motor 2 (FIG. 1). Electric motor 2 is flanged to a gearing 3, which is secured at the side and on the outside to a support frame 4 of the cable block 1.

As shown in FIG. 1, rectangular support frame 4 comprises two face plates 5*a*, 5*b*, which are joined together by two longitudinal members 6. The two rectangular face plates 5*a*, 5*b* are spaced apart by the longitudinal members 6 and are oriented parallel to each other with their inner surfaces 5*c* facing each other. In the illustrated embodiment, longitudinal members 6 are shaped as tubes, and only two longitudinal members 6 are provided with support frame 4. The two longitudinal members are arranged at opposite corners of the face plates 5*a*, 5*b*.

Figure 2:
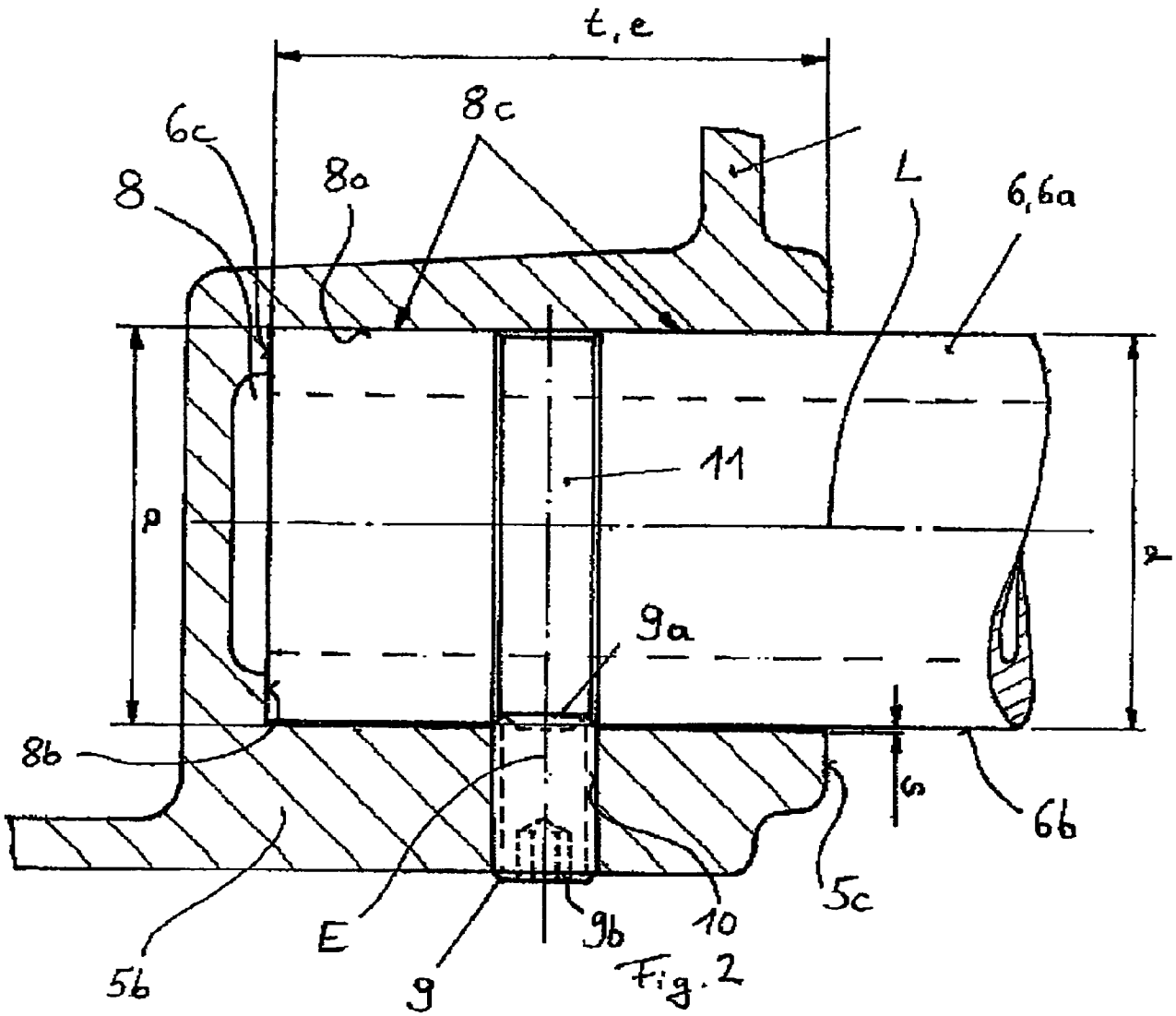
FIG. 2 is a side elevation of an end of a longitudinal member attached to a face plate of the hoisting device according to the present invention.

As best shown in FIG. 2, longitudinal members 6 may be inserted by their opposite ends 8*a* into boreholes 8 of face plates 5*a*, 5*b* and may be held by a radial screw connection with a stud 9. Boreholes 8 may be located in the corner regions of the inner surfaces 5*c* of face plates 5*a*, 5*b* and may be configured as stepless blind boreholes.

Furthermore, a cable drum 7 of cable block 1 may be mounted between and on face plates 5*a*, 5*b*. The axis of rotation D of the cable drum 7 may run parallel to the lengthwise dimension L of longitudinal members 6.

Face plates 5*a*, 5*b* are also housing parts, which may perform various functions of the hoisting device. For example, face plates 5*a*, 5*b* may carry the electric drive 2 or stow the cable drum 7. Optionally, face plates 5*a*, 5*b* may be used to attach cross beams for the cable reeving parts or to fasten the base of the hoisting device. Further, face plates 5*a*, 5*b* may be used to accommodate the electrical equipment or the running gear parts of the hoisting device.

As shown in FIG. 2, longitudinal members 6 are connected to face plates 5*a*, 5*b*. As previously described and as shown in FIG. 1, boreholes 8 for longitudinal members 6 may be arranged in at least two opposite corner regions of each face plate 5*a*, 5*b*, emerging from inner surfaces 5*c*. The lengthwise axis L of boreholes 8 may extend in the assembled condition of the support frame 4 or that of the entire cable block 1 in parallel with the axis of rotation D of the cable drum 7. Furthermore, boreholes 8 may each be configured as blind holes with a cylindrical inner circumferential surface 8*a*. At the bottom of each borehole 8, an annular stopping surface 8*b* may be fashioned, bordering on its inner circumferential surface 8*a*. The shape of the bottom of each borehole 8 depends on the type of drilling tool used to make the blind hole. Borehole 8 has a depth t and a diameter a.

Moreover, as shown in FIG. 2, longitudinal member 6 may be fashioned as a round tube and may have an outer diameter d that is slightly smaller than the inner diameter a of borehole 8. Thus, in the process of assembling support frame 4, longitudinal members 6 may be simply inserted by their ends 6*a* into boreholes 8. The insert length e of the ends 6*a* of the longitudinal members 6 may correspond to depth t of borehole 8. In the inserted configuration, end 6*a* of longitudinal member 6 abuts by its annular planar end surface 6*c* against annular stopping surface 8*b* at the bottom of borehole 8. Thus, the insert length e is limited, and the spacing between the two face plates 5*a*, 5*b* is determined indirectly by longitudinal member 6.

Longitudinal members 6 may be held in boreholes 8 by a radial screw fastener, with at least one stud 9 for each fastener (FIG. 2). Stud 9 may be a threaded pin per DIN 916 with a circular hardened annular cutting edge 9*a* at one end and a hex socket 9*b* or other connection surface for a tool at the other end. Stud 9 may be screwed into a threaded bore 10 in order to secure longitudinal member 6 in borehole 8. Threaded bore 10 may be arranged in a part of the face plates 5*a*, 5*b* surrounding borehole 8 and, thus, in the wall of borehole 8. Stud 9 may be screwed into threaded bore 10 so deep that its cutting edge 9*a* cuts into the outer circumferential surface 6*b* of end 6*a* of the longitudinal member 6. The resulting form fit between stud 9 and longitudinal member 6 may enhance the strength of the connection between the two longitudinal members 6 and the two face plates 5*a*, 5*b*. *Stud* 9 *may be oriented for the desired radial screw fastening with its lengthwise axis E at a right angle to the lengthwise axis D of longitudinal member* 6.

The dimensions and tightening torques of studs 9 may vary in broad limits and may be attuned to one another so that the expected torques and forces in support frame 4 and, thus, in the connections between borehole 8, stud 9 and longitudinal member 6, may be absorbed or transmitted with sufficient safety.

Moreover, as shown in FIG. 2, the axial force created by the controlled tightening torque of the stud 9 may press end 6*a* of longitudinal member 6 against a portion of the inner circumferential surface 8*a* of borehole 8, known as the bearing surface 8*c*. The required axial parallelness of borehole 8 and longitudinal member 6 may be permanently secured; thus, face plates 5*a*, 5*b* may be properly oriented with each other. Furthermore, the corner torques may be absorbed in this way, because the length of bearing surface 8*c*, which corresponds to the insert length e, is larger than the diameter d, which serves as the basis of support in the axially secured designs of the prior art. Because of the pressing of longitudinal member 6 through stud 9 against bearing surface 8*c*, a gap s arises at the opposite end of longitudinal member 6, between inner circumferential surface 8*a* of borehole 8 and outer circumferential surface 6*b* of longitudinal member 6. Also, as previously described, outer diameter d of longitudinal member 6 is slightly smaller than inner diameter a of borehole 8, to facilitate the assembly process.

Furthermore, as shown in FIG. 2, an increased strength of the connection between the longitudinal member 6 and face plate 5*a*, 5*b* via stud 9 may be achieved by a continuous groove 11 provided in the outer circumferential surface of longitudinal member 6. Groove 11, oriented transversely to the lengthwise axis L of longitudinal member 6, is arranged roughly in the middle of the insert length e of end 6*a* of longitudinal member 6, looking in the direction of the lengthwise axis L. Groove 11 has a width roughly corresponding to the width of annular cutting edge 9*a* of stud 9. The strength of the connection may be further enhanced in that annular cutting edge 9*a* of stud 9 may also penetrate into groove 11 when it is screwed in. The depth of groove 11 may be as small as possible, yet large enough to achieve the desired resistance to being pulled out.

The proper axial position of longitudinal member 6 in borehole 8 may be achieved by either depth t of borehole 8 coinciding with the desired insert length L of longitudinal member 6, or, alternatively, continuous groove 11 at the circumference of longitudinal member 6 aligning with stud 9.

Furthermore, insert length e of ends 6*a* of longitudinal members 6 into the respective boreholes 8 of face plates 5*a*, 5*b* may be large enough that support frame 4 may achieve a sufficient stability with only two diagonally opposite arranged longitudinal members 6. Comparable designs of support frames 4 have had at least three longitudinal members 6. In the illustrated embodiment, only one stud 9 is used for each end 6*a* of the longitudinal member being secured. Optionally, several studs 9 may be used for each end 6*a*.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A hoisting device, comprising:

a support frame having at least two face plates detachably joined together and spaced apart by at least two longitudinal members, said longitudinal members being detachably joined to said face plates, said longitudinal members each having a lengthwise axis and at least two ends, wherein said ends are pressed against a bearing surface of said face plates transversely to said longitudinal members; and a cable drum mounted between said face plates, said cable drum having an axis of rotation parallel to said lengthwise axis of said longitudinal members, wherein said ends of said longitudinal members are each pressed against said bearing surface by a connection element, said connection element thrusting against said face plate radially with respect to said lengthwise axes of said longitudinal members.

2. The hoisting device of claim 1, wherein a gearing is secured to said support frame.

3. The hoisting device of claim 1, wherein said hoisting device is a cable block.

4. The hoisting device of claim 1, wherein said connection element is a stud.

5. The hoisting device of claim 1, wherein an end of said connection element is pressed onto an outer circumferential surface of said longitudinal member to produce a form fitting.

6. The hoisting device of claim 5, wherein said connection element is a stud.

7. The hoisting device of claim 6, wherein said stud is a threaded pin with an annular cutting edge to produce the form fitting.

8. The hoisting device of claim 6, wherein said stud is screwed into a threaded borehole positioned in said face plate adjacent to said borehole, said threaded borehole having a lengthwise axis pointing transversely to said lengthwise axis of said longitudinal member.

9. The hoisting device of claim 1, said face plates having mutually facing inner surfaces, said inner surfaces having boreholes, wherein said ends of said longitudinal members are inserted into said boreholes.

10. The hoisting device of claim 9, wherein a length of insertion of said ends of said longitudinal members into said boreholes is greater than a diameter of said ends of said longitudinal members.

11. The hoisting device of claim 9, wherein said boreholes are blind boreholes.

12. The hoisting device of claim 9, wherein said face plates are rectangular and have four corners, wherein one borehole is arranged in each corner of said face plates, said boreholes being arranged concentrically to a center point of said cable drum and staggered by 90 degrees relative to one another.

13. The hoisting device of claim 1, wherein said longitudinal members being fastened in parallel and diagonally opposite with respect to said face plates.

14. The hoisting device of claim 1, wherein said longitudinal members are configured as round tubes.

15. The hoisting device of claim 1, wherein said longitudinal members are configured as a single piece.

16. A hoisting device, comprising:

a support frame having at least two face plates detachably joined together and spaced apart by at least two longitudinal members, said longitudinal members being detachably joined to said face plates, said longitudinal members each having a lengthwise axis and at least two ends, wherein said ends are pressed against a bearing surface of said face plates transversely to said longitudinal members; and a cable drum mounted between said face plates, said cable drum having an axis of rotation parallel to said lengthwise axis of said longitudinal members, wherein said ends of said longitudinal members are pressed against said bearing surface by a connection element, said connection element thrusting against said face plate radially with respect to said lengthwise axes of said longitudinal members; and a gearing secured to said support frame and an electric motor operatively connected at said gearing.

17. The hoisting device of claim 16, wherein said connection element is a stud.

18. The hoisting device of claim 17, wherein said stud is a threaded pin with an annular cutting edge to produce the form fitting.

19. The hoisting device of claim 17, said face plates having mutually facing inner surfaces, said inner surfaces having boreholes, wherein said ends of said longitudinal members are inserted into said boreholes.

20. The hoisting device of claim 19, wherein a length of insertion of said ends of said longitudinal members into said boreholes is greater than a diameter of said ends of said longitudinal members.

21. The hoisting device of claim 20, wherein said boreholes are blind boreholes.

22. The hoisting device of claim 21, wherein said stud is screwed into a threaded borehole positioned in said face plate adjacent to said borehole, said threaded borehole having a lengthwise axis pointing transversely to said lengthwise axis of said longitudinal member.

23. The hoisting device of claim 22, wherein each of said face plates is rectangular and has four corners, wherein one borehole is arranged in each corner of said face plates, said boreholes being arranged concentrically to a center point of said cable drum and staggered by 90 degrees relative to one another.

24. The hoisting device of claim 23, having two longitudinal members, said longitudinal members being fastened in parallel and diagonally opposite with respect to said face plates.

25. The hoisting device of claim 24, wherein said longitudinal members are configured as round tubes.

26. The hoisting device of claim 25, wherein said longitudinal members are formed as a single piece.

27. The hoisting device of claim 16, wherein an end of said connection element is pressed onto an outer circumferential surface of said longitudinal member to produce a form fitting.

28. The hoisting device of claim 27, wherein said connection element is a stud.

* * * * *